US009593505B2

(12) United States Patent
Pryor

(10) Patent No.: US 9,593,505 B2
(45) Date of Patent: Mar. 14, 2017

(54) SELF-CENTERING BRACED FRAME FOR SEISMIC RESISTANCE IN BUILDINGS

(71) Applicant: Steven E. Pryor, Dublin, CA (US)

(72) Inventor: Steven E. Pryor, Dublin, CA (US)

(73) Assignee: Simpson Strong-Tie Company, Inc., Pleasanton, CA (US)

( * ) Notice: Subject to any disclaimer, the term of this patent is extended or adjusted under 35 U.S.C. 154(b) by 0 days.

(21) Appl. No.: 14/866,658

(22) Filed: Sep. 25, 2015

(65) Prior Publication Data

US 2016/0017625 A1 Jan. 21, 2016

Related U.S. Application Data

(63) Continuation of application No. 14/145,957, filed on Jan. 1, 2014, now abandoned.

(51) Int. Cl.

| | |
|---|---|
| ***E04H 9/02*** | (2006.01) |
| ***E04B 1/24*** | (2006.01) |
| ***E04C 3/04*** | (2006.01) |
| *E04C 3/02* | (2006.01) |

(52) U.S. Cl.

CPC ..... *E04H 9/021* (2013.01); *E04B 1/24* (2013.01); *E04C 3/04* (2013.01); *E04B 2001/2496* (2013.01); *E04C 2003/026* (2013.01); *E04C 2003/0413* (2013.01); *E04H 9/028* (2013.01)

(58) Field of Classification Search

CPC ... E04B 1/36; E04B 1/98; E04B 1/985; E04B 1/24; E04B 2001/2496; F16F 7/123; F16F 7/125; F16F 7/128; F16F 7/14; F16F 2236/06; E04H 9/00; E04H 9/026; E04H 9/02; E04H 9/024; E04H 9/021;

(Continued)

(56) References Cited

U.S. PATENT DOCUMENTS

| | | | |
|---|---|---|---|
| 2,126,511 | A | 8/1938 | Soule |
| 2,302,101 | A | 11/1942 | Boydstun |
| 2,389,573 | A | 11/1945 | Balduf |

(Continued)

FOREIGN PATENT DOCUMENTS

| | | |
|---|---|---|
| AU | 50272 | 6/1977 |
| AU | 2006100777 | 11/2006 |

(Continued)

OTHER PUBLICATIONS

Filiatrault, Andre, Ph.D., Eng., "Self-Centering Earthquake Resisting Systems," CIE500D "Introduction to Graduate Research in Structural Engineering," published at least as early as Sep. 15, 2008, 23 pages, URL: http://wwwcourses.sens.buffalo.edu/cie500d/Filiatrault%20-%20presentation%2009-15-08.pdf, University of Buffalo, New York.

(Continued)

*Primary Examiner* — Jessica Laux

(74) *Attorney, Agent, or Firm* — James R. Cypher; Charles R. Cypher

(57) ABSTRACT

An elongated tension-only or centering brace for a structural frame is provided where the brace is anchored at a first attachment point and to a second attachment point that is removed from the first attachment point. The elongated tension-only brace has one or more elastic restoring force elements that have effective lengths greater than the length of the tension only brace between the attachment points.

20 Claims, 10 Drawing Sheets

(58) Field of Classification Search
CPC . E04H 9/029; E04H 9/022; E04C 3/04; E04C 2003/0413; E04C 2003/026
See application file for complete search history.

(56) References Cited

U.S. PATENT DOCUMENTS

| | | | | |
|---|---|---|---|---|
| 2,856,646 | A | 10/1958 | Latimer | |
| 2,964,807 | A | 12/1960 | Kennedy | |
| 3,004,640 | A | 10/1961 | Macomber | |
| 3,010,162 | A | 11/1961 | Klein | |
| 3,332,196 | A | 7/1967 | Tuttle | |
| 3,335,993 | A | 8/1967 | Tuttle | |
| 3,591,997 | A | 7/1971 | Tennison | |
| 3,875,719 | A | 4/1975 | Menge | |
| 3,959,945 | A | 6/1976 | Allen | |
| 4,016,698 | A | 4/1977 | Rogers | |
| 4,040,232 | A | 8/1977 | Snow et al. | |
| 4,130,970 | A | 12/1978 | Cable | |
| 4,157,002 | A | 6/1979 | Adolph | |
| 4,339,903 | A | 7/1982 | Menge | |
| 4,345,409 | A | 8/1982 | Schroeder et al. | |
| 4,367,973 | A | 1/1983 | Gilb et al. | |
| 4,370,843 | A | 2/1983 | Menge | |
| 4,409,765 | A | 10/1983 | Pall | |
| 4,843,726 | A | 7/1989 | Ward | |
| 5,161,345 | A | 11/1992 | Sobjack, Sr. | |
| 5,315,803 | A | 5/1994 | Turner | |
| 5,388,378 | A | 2/1995 | Frye | |
| 5,454,203 | A | 10/1995 | Turner | |
| 5,491,949 | A | 2/1996 | De Moor | |
| 5,606,837 | A | 3/1997 | Holizlander | |
| 5,842,312 | A * | 12/1998 | Krumme et al. | 52/167.1 |
| 6,185,898 | B1 | 2/2001 | Pratt | |
| 6,256,043 | B1 | 7/2001 | Mander et al. | |
| 6,438,905 | B2 | 8/2002 | Constantinou | |
| 6,877,291 | B2 | 4/2005 | Shamroukh et al. | |
| 6,988,346 | B2 | 1/2006 | Shamroukh et al. | |
| 8,001,734 | B2 | 8/2011 | Pryor et al. | |
| 8,109,124 | B2 | 2/2012 | Lin | |
| 8,250,818 | B2 * | 8/2012 | Tremblay et al. | 52/167.3 |
| 8,316,589 | B2 | 11/2012 | Chou et al. | |
| 2008/0016794 | A1 | 1/2008 | Tremblay et al. | |
| 2011/0308190 | A1 | 12/2011 | Pryor et al. | |
| 2012/0038091 | A1 * | 2/2012 | Tagawa | 267/136 |
| 2014/0305048 | A1 * | 10/2014 | Ishii et al. | 52/167.1 |

FOREIGN PATENT DOCUMENTS

| | | |
|---|---|---|
| GB | 2301604 | 9/1999 |
| JP | 203571 | 8/1989 |

OTHER PUBLICATIONS

Stewart, Alan Jamel, "Experimental Analysis of Self-Centering Moment Resisting Frames," published at least as early as Mar. 29, 2013, 20 pages, publisher unknown.

Garlock, Maria E., Li, Jie, and Blaisdell, Mary Lisbeth, "Floor Diaphragm Interaction With Steel Self-Centering Moment Frames", published at least as early as Mar. 29, 2013, 10 pages, publisher unknown.

* cited by examiner

SELF-CENTERING BRACED FRAME FOR SEISMIC RESISTANCE IN BUILDINGS

BACKGROUND OF THE INVENTION

The present invention provides a self-centering system for the structural frame of a building, in particular, the present invention provides a tension brace that provides elastic restoring forces to the frame of the building.

After an earthquake, permanent damage in even properly designed structures may allow for a building to come to rest in an out-of-plumb condition, which is often referred to as "residual (horizontal) displacement". At best this can lead to loss of use (red tag) and at worst complete collapse in subsequent aftershocks. In recent years state-of-the-art earthquake resistant design research has focused on systems that are capable of ensuring that after an earthquake a building would have little, if any, residual displacement, thus they are "self-centering". The proposed invention is such a system.

Various types of self-centering systems have been proposed. Inherent in the self-centering philosophy is the need for something in the structure to be pre-stressed and implemented into the building design in such a way that if a building is distorted during an earthquake, the pre-stressed element acts to pull the building back into alignment with its original position when the shaking stops. The pre-stressing allows the element to keep pulling with more than sufficient force all the way back to its original position, wherein the element is still pre-stressed at the conclusion of returning the structure back to its original form. For this to happen the pre-stressed element must remain elastic (unyielding) even as it is stretched under the combined demands of the pre-stressing and the supplemental strain induced by building deformations during an earthquake, and it is in meeting these combined strain demands by stretching without yielding that many of the difficulties of designing such systems are encountered. The present invention addresses these combined strain demands in a novel way, and at the same time allows a self-centering system to be designed that alleviates some of the additional challenges created in alternate earthquake-resistant building designs with self-centering systems.

Supplemental to the design of a self-centering system is the need to provide for dissipation of the seismic energy imparted into the building during an earthquake. The elastic, pre-stressed elements of the self-centering system, much like rubber bands, stretch and return to their original length without dissipating much energy. This is because the restoring force elements must be displaced only elastically so that they can recenter the building. Accordingly, some form of additional energy dissipation is usually (although not always) also included into proposed designs for a self-centering earthquake resistant structure, quite often in the form of a metallic yielding device of some kind. While there are many ways this could be accomplished (and with things other than metallic yielding devices, such as viscous dampers or fictional dampers), in the preferred embodiment of the proposed invention, the metallic yielding devices of U.S. Pat. Nos. 8,001,734 and 8,375,652 and US Patent Publication 2011/0308190 A1, would be incorporated into the system to fulfill the role of providing added energy dissipation. U.S. Pat. Nos. 8,001,734 and 8,375,652 are incorporated herein by reference. The disclosure of US Patent Publication 2011/0308190 A1, application Ser. No. 12/967,462 is also incorporated herein by reference.

Many types of earthquake resistant buildings with self-centering systems have been proposed and are being researched. The various types of geometry proposed for buildings with self-centering systems include: tall rocking braced frames that dissipate energy through the rocking movement of the frame and which are anchored at their tops by elongated steel tendons to provide self-centering; moment-resisting frames with gap opening behavior at the beam-column joints to dissipate energy and long tendons that connect multiple post and beam joints to self-center the building; and more standard braced-frame buildings that use diagonal braces made with superelastic alloys (shape memory alloys) to provide self-centering.

One of the challenges of self-centering systems is configuring the geometry of the building and the self-centering system in such a way that the strain induced in the elastic restoring force elements that provide the force necessary to pull the building back to its original position (this is called the "restoring force") does not exceed the yield strain for the materials from which the elastic force restoring elements are made. As noted above, the elastic restoring force elements need to remain elastic throughout any design elongation or stretch so that they can return to their original geometry and bring the building back to its original position.

The amount of stretch that can be tolerated in typical, widely available materials, such as steel, before they begin to yield can be calculated from the equation $$\frac{F_y \cdot L}{E},$$

where $F_y$ is the material yield stress, L is the length of the material available to stretch, and E is the modulus of elasticity for the material. By way of example, a steel rod with a yield stress of 100,000 psi and a length of 10 feet can only stretch 0.4 inches before it begins to yield. That is to say, before it plastically deforms and then is unable to return to its original length or shape. If that rod is comprised of material with a yield stress of 200,000 psi, the rod will begin to yield after 0.8 inches of stretch.

As a result, designers who have wanted to use commercially available materials such as steel in their restoring force elements have focused on building designs that use long restoring force elements that need only elongate a small amount under the earthquake design load and thus do not elongate past their yield point. Such designs typically involve high aspect ratio geometries as with rocking frames, or with moment resisting frames designed with gap opening behavior at the beam-column joints with tendon rods spanning many beam and column joints to provide sufficiently long tendon rods. One researcher, Alan Jamal Stewart, has found that tendon yielding and loss of elasticity can still be a problem with moment-resisting frames designed with gap opening behavior at the beam-column joints.

Self-centering moment frame systems that rely on the gap-opening behavior of beam-to-column joints to dissipate energy also have a problem in their design that may interfere with their adoption. The structure is built with everything in its original condition and the as-designed fixed dimensions of the floor. Under lateral loading the gaps that form at the tops and bottoms of the beams at beam-column connections essentially pry the structure apart. The bare steel frames may not have a problem by themselves, but the building also contains a floor diaphragm system that is delivering the seismic inertial forces to the frames that are resisting lateral load, and this floor diaphragm does not want to be spread apart. While initially this was considered an academic problem in that it was mostly theoretical, the Feb. 22, 2011, Christchurch, New Zealand earthquake has now provided real-world examples of why this is a problem.

Self-centering systems that rely on high aspect ratio rocking frames also create a unique set of problems in addition to the possible yielding of the restoring force elements mentioned above with respect to moment resistant frames that rely on gap opening. High aspect ratio rocking frame systems work by allowing the (multi-story) frame to rock on the foundation under the effects of lateral loading. At each end of the rocking frame (or somewhere along its lateral width) elastic restoring force elements run from the foundation to the top of the frame to try to pull the side that has lifted back down into contact with the foundation. Aside from the detailing challenges of providing for this controlled vertical slip at the column bases, the actual shear forces carried by the frame must still be transferred to the foundation through a connection designed to do this while not compromising the rocking behavior of the frame. However, perhaps the biggest challenge with rocking self-centering frames is designing the interface with the surrounding structure. Somehow the building must be able to "push" on the frames while not interfering with the rocking mechanism of the frame. And gravity load must either be prevented from acting on the frame, or the connection of gravity load carrying members to the frame must be carefully considered in the overall design, taking care to not restrict the rocking mechanism of the frame either by placing too much gravity load on it or creating structural stiffness in the surrounding framing that prevents the desired rocking behavior.

The proposed invention aims to solve these problems by going back to a conventional bracing geometry. Conventional bracing geometry typically does not work because the axial strain demands (stretch) imposed on the braces would be too large to accommodate without yielding; however, the benefits to this approach is that the frame no longer has to rock, avoiding the associated problems of rocking frames, and the beam-column joints do not have to allow for gap opening as described above in the self-centering moment frame system. The proposed invention effectively increases the available stretch length of a tension brace in an otherwise fixed geometry.

FIG. 15 shows a schematic of a typical three-story braced frame structure where the self-centering elastic resisting force elements of the present invention could be used. The frame is configured such that the columns are 20 feet apart horizontally, and the beams are 14 feet apart vertically. FIG. 16 is a close up of any one of the brace-beam intersection points and shows, with solid lines, the undeformed shape, and in dashed lines the deformed brace geometry if three inches of interstory drift having been imposed on the story. Three inches interstory drift is a typical design parameter for braced frame structures. Measuring the change in length of the brace (being stretched in tension) we see that it must elongate 1.8" to accommodate the interstory drift of three inches. The length of the brace (theoretically point to point for this discussion, but in reality a bit shorter due to the physical dimensions of the beam, column and connections) is 206 inches. In order for steel member that is 206 inches in length to stretch 1.8 inches without yielding, the yield stress of the steel would have to be at least 253,400 psi, which is not feasible. Additionally, as mentioned previously elastic restoring force elements (in this case the inclined braces), need to be prestressed in order for them to exert a centering restorative force, which would drive up the required yield stress by the selected amount of prestress.

The present invention provides an elastic restoring force element that has a primary length on the order of 206 inches, but effectively creates an elastic restoring force element that has a stretch length several times that.

SUMMARY OF THE INVENTION

The present invention provides an elongated tension-only or centering brace in a building where the brace is anchored at a first attachment point, typically, the first attachment point would be an upstanding post, and to a second attachment point that is removed from the first attachment point, typically somewhere along a beam. The elongated tension-only brace has one or more elastic restoring force elements that have effective lengths greater than the length of the tension only brace between the beam and the post. The effective lengths of the elastic restoring force elements are long enough such that they do not stretch beyond their yield points under the combined effects of selected design loads, such as those caused by an earthquake, and prestressing, thus the brace acts only in elastic movement and thus when the force stops that wants to elongate the brace, the brace will return to its original length, pulling the building frame elements back to their original centered position.

The present invention provides a connection between a first structural member having a first attachment point and a second structural member in a structural frame having a second attachment point spaced away from the first attachment point, by means of a brace spanning the distance between the first and second attachment points and connecting the first and second structural members at the first and second attachment points, the brace having a minimum effective length that is the distance between the first and second attachment points when the first and second structural members are not subject to external lateral loading, the brace also being able to expand in length from the first effective minimum effective length when the structural frame is subjected to lateral loading that increases the distance between the first and second attachment points, the brace including a plurality of brace members in sliding engagement with each other, one of the plurality of brace members being connected to the first attachment point and one of the plurality of brace members being connected to the second attachment point, the first and second attachment points defining an elongated axis of the brace, and one or more elastic restoring force elements that generally extend along the elongated axis of the brace, each elastic restoring force element being in connection with at least the brace members connected to the first and second attachment points, the one or more elastic restoring force elements being flexible such that the one or more elastic restoring force elements are run over one or more return members connected to the brace such that the one or more elastic restoring force elements have a minimum effective length that is greater than the minimum effective length of the brace.

This object of the present invention to provide a centering brace can be accomplished by forming an elongated tension-only brace with a relatively short brace member and an elongated brace member that are connected to each other by one or more elastic restoring force elements. The components of the brace are connected in a manner that in the absence of any other forces the one or more elastic force restoring elements hold the short and elongated brace members in bearing relation in a first selected relative position where the tension-only brace has a minimum effective length measured from the first attachment point to the second attachment point. The short brace member and the elongated brace member can be moved from this first selected relative position by an external, separating force on the beam and post such as by an earthquake, such that the tension only brace exceeds the minimum effective length, but this movement from the first selected relative position is resisted by the one or more elastic force restoring elements, and at the cessation of the external force the one or more elastic force restoring elements return the short and elongated brace members to the first selected relative position and their previous bearing relationship. In the preferred embodiment one of the short brace member and the elongated brace member is in nesting engagement with the other brace member.

This object of the present invention can be achieved by forming the one or more elastic restoring force elements as elongated cables and fixing one end of each cable that is used to the short brace member, running the cable away from the short brace member to a redirecting pulley on the elongated brace member such that the cable is redirected back toward the short brace member and anchoring the other end of the cable on the elongated brace member at a point away from the redirecting pulley such that the length of the cable exceeds the minimum effective length of the brace. If the elongated brace member is maximized such that it comprises as much as the effective minimum length of the elongated brace as is possible, then the effective length of the cable is almost twice what it would be if it could only stretch between the first attachment point and the second attachment point.

This object of the present invention is further provided by affixing a second redirecting pulley to the elongated brace member at a distance along the elongated brace member that is removed from the first redirecting pulley and winding the cable around this second pulley as well before it is anchored to distal end of the elongated brace member.

Preferably, the second pulley is located near the end of the elongated brace member that is proximal to the short brace member and the first redirecting pulley is located near the end of the elongated brace member that is distal from the short brace member, and the elastic restoring force element is anchored to the short brace member and the distal end of the elongated brace member. Also preferably, both the first redirecting pulley and the second redirecting pulley are spaced as far from each other as they can be on the elongated brace member, and if the elongated brace member is maximized such that it comprises as much of the effective minimum length of the elongated brace as is possible, then the effective length of the cable is almost thrice what it would be if it could only stretch between the first attachment point and the second attachment point.

This object can further be achieved by creating the redirecting pulleys and the second pulley as blocks with sets of wheels rotating independently on an axle and with the cable wound over the blocks more than once such that effective length can be increased beyond just three times. It is conceived that this arrangement could be repeated several times.

This object could also be achieved by adding pulleys located at different points along the elongated bracing portion and winding the cable around the additional pulleys as well to provide a longer cable.

The short brace member and the elongated brace member could be of substantially equal lengths or approximately equal length, although optimal lengthening of the restoring force elements is provided when the elongated brace member is as long as possible compared to the short brace member.

DETAILED DESCRIPTION

Figure 1:
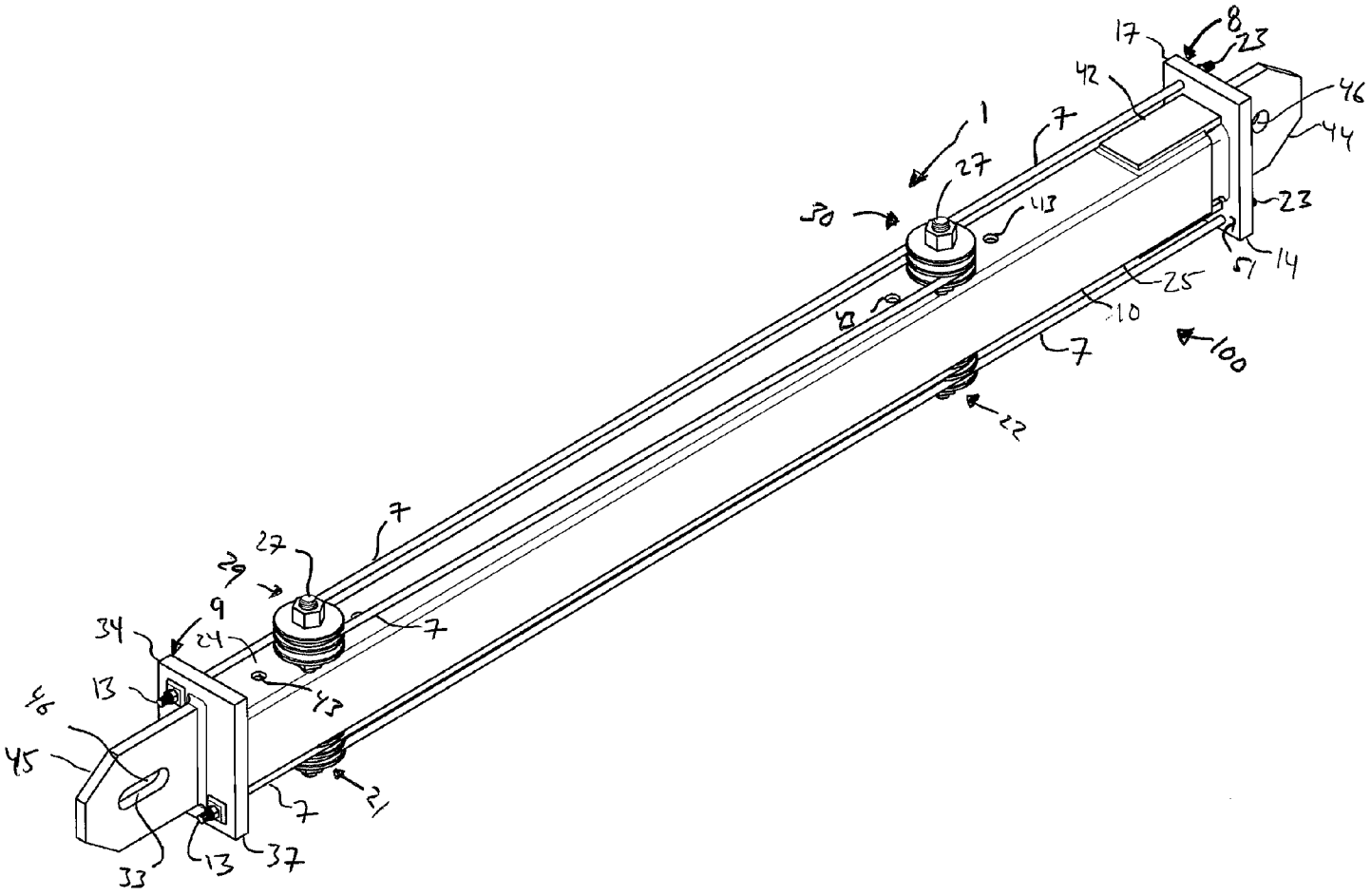
FIG. 1 is a perspective view of the centering brace of the present invention.
Figure 2:
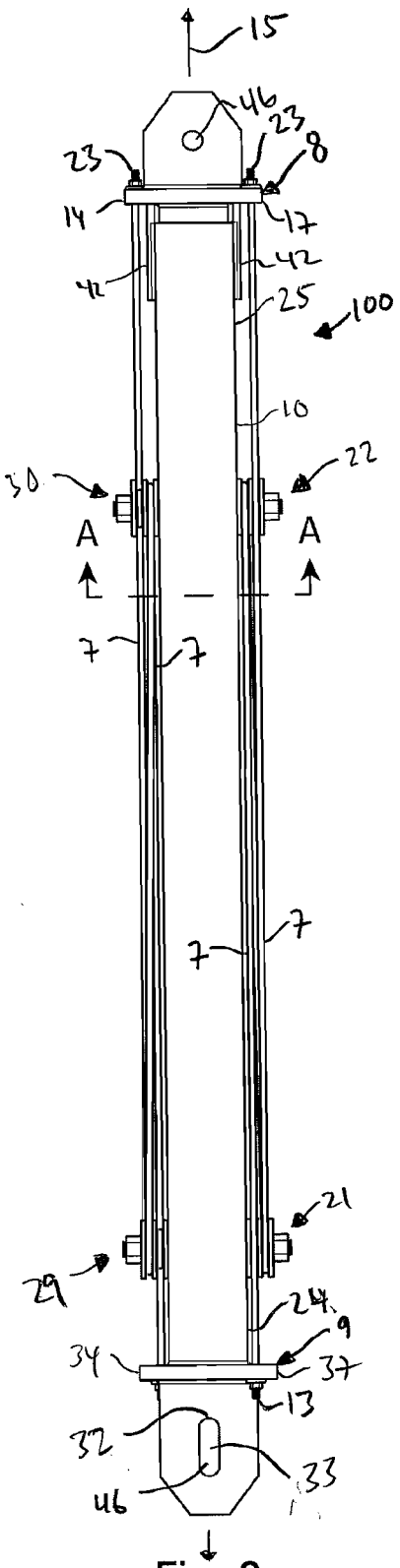
FIG. 2 is top view of the centering brace of FIG. 1.
Figure 3:
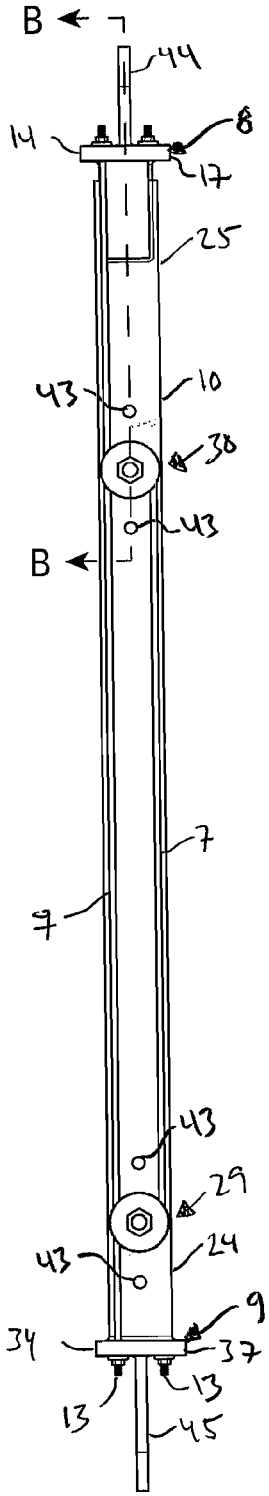
FIG. 3. is a front view of the centering brace of FIG. 1.
Figure 4:
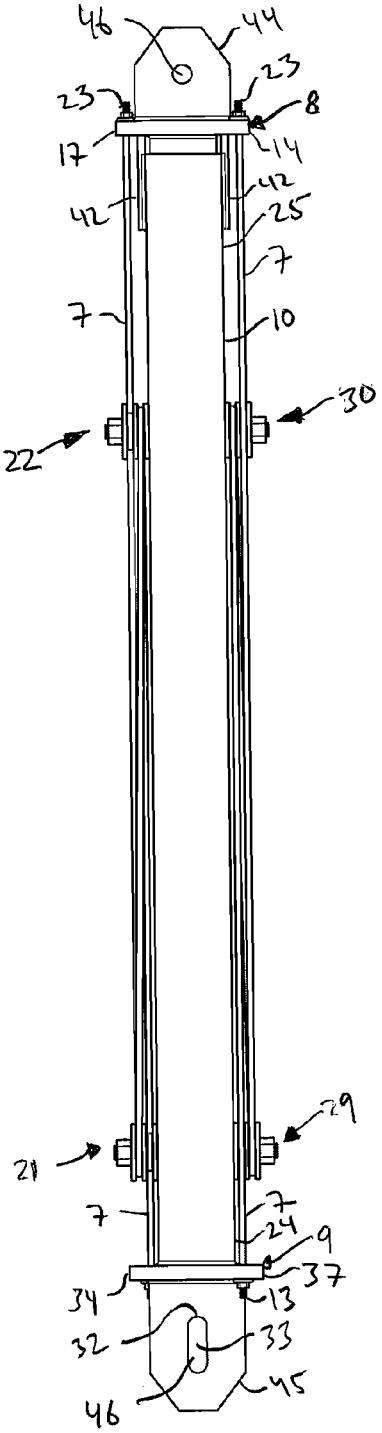
FIG. 4 is a bottom view of the centering brace of FIG. 1.
Figure 5:
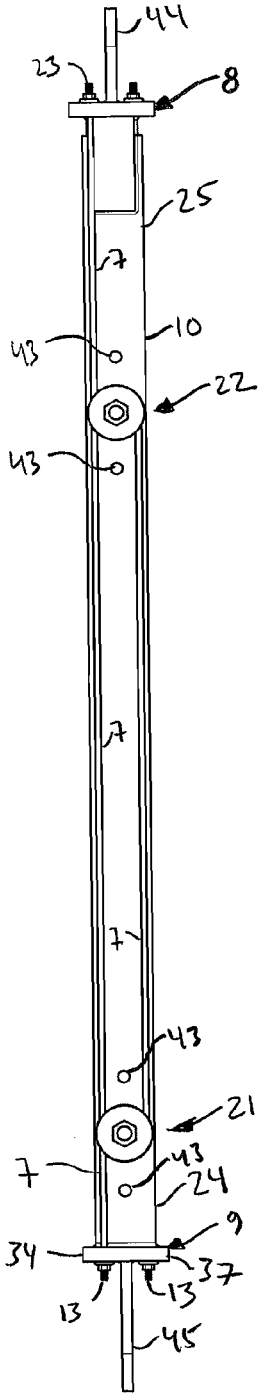
FIG. 5 is a back view of the centering brace of FIG. 1.
Figure 6:
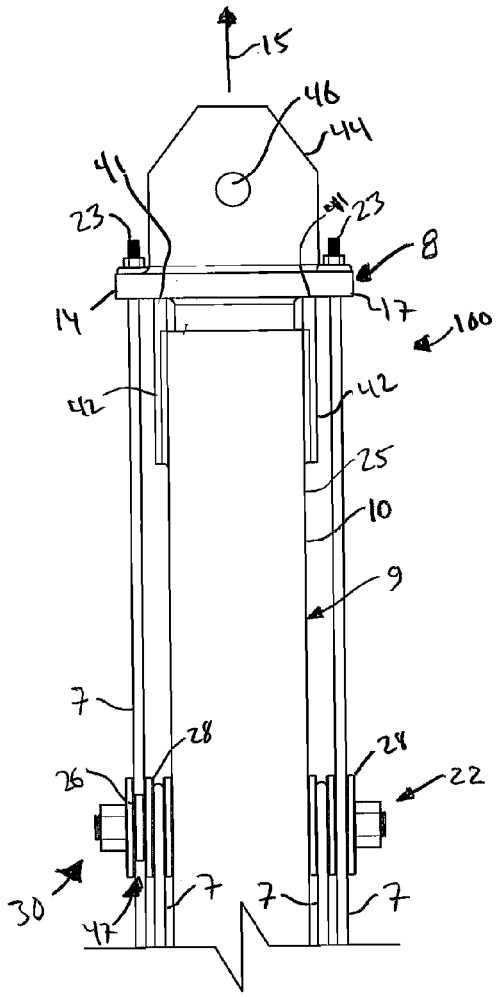
FIG. 6 is an enlarged top view of the centering brace of FIG. 1, where the short brace member is received by the elongated brace member, when the centering brace is in its unexpanded position at its minimum effective length.
Figure 7:
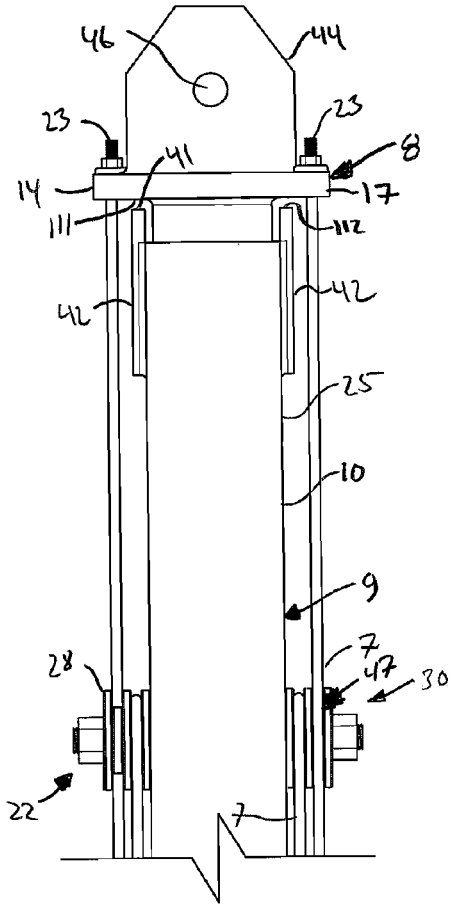
FIG. 7 is an enlarged top view of the centering brace of FIG. 1, where the short brace member is received by the elongated brace member, when the centering brace is in an expanded position as when it is under a tension load and the short brace member does not bear upon the elongated brace member.

The present invention provides an elongated, tension-only or centering brace 1 in a frame 2 for a structure, such as a building, where the brace is anchored at a first attachment point 3, typically, the first attachment point would be along an upstanding post or column 4, and where the brace is anchored at a second attachment point 5 that is removed from the first attachment point 3, typically at a point somewhere along a beam 6. The elongated tension-only brace has one or more elastic restoring force elements 7 that have effective lengths greater than the distance between the first and second attachment points, where the brace 1 is anchored. The effective lengths of the elastic restoring force elements are long enough such that they do not stretch beyond their yield points under selected design loads, such as those caused by an earthquake. Typically the vertical columns and horizontal beams of the frame that would use such a brace would be made from steel "W" sections which have an 'H'-shaped profile.

Figure 12:
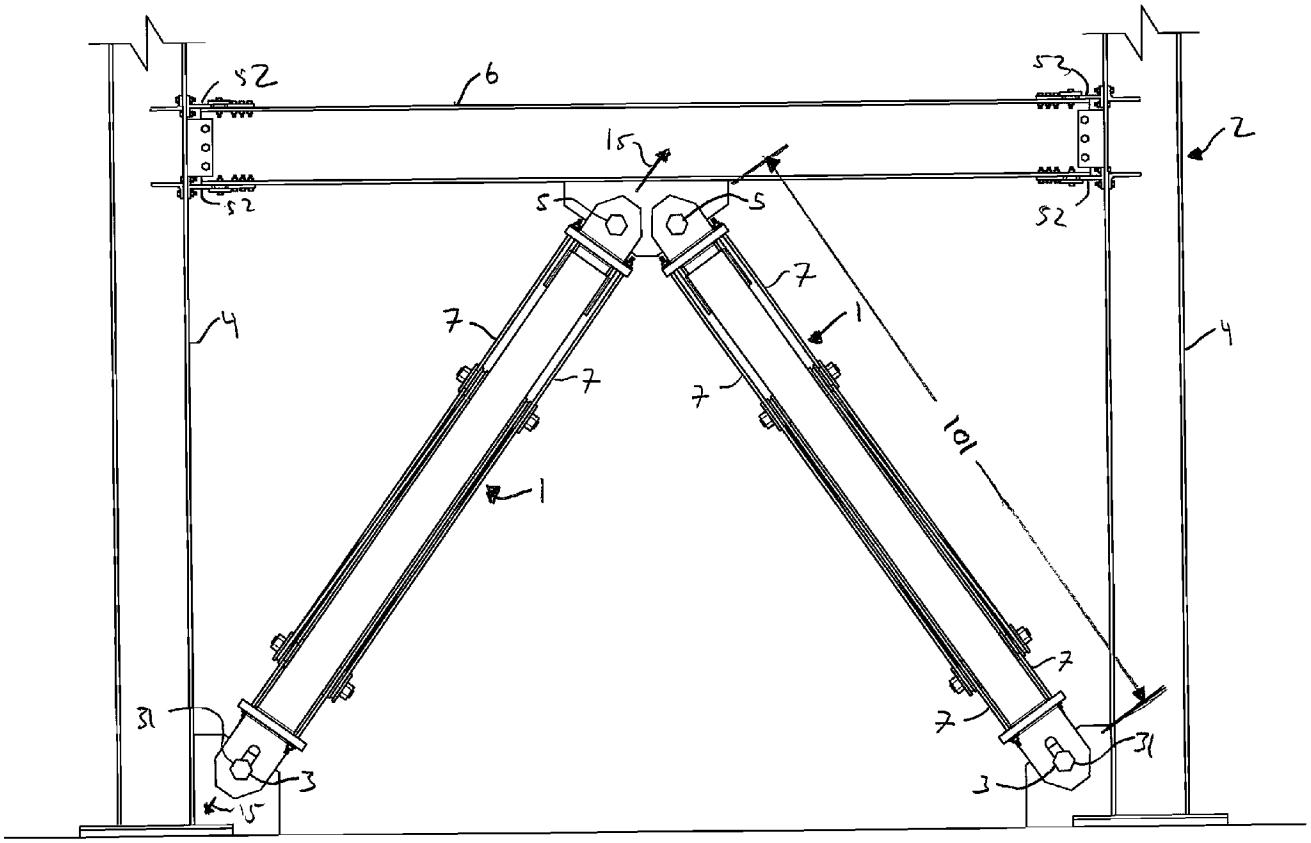
FIG. 12 is a front view of a pair of centering braces of the present invention installed in a building frame. The beam of the building frame is connected to the uprights of the frame with fused connections to dissipate energy imparted by the frame as by an earthquake or other lateral loading.

As shown in FIG. 1, in the preferred embodiment, centering brace 1 can be provided by forming the brace 1 with a relatively short brace member 8 and an elongated brace member 9 that are connected to each other by one or more elastic restoring force elements 7. As shown in FIG. 12, the components of the brace 1 are connected in a manner that in the absence of any other forces the one or more elastic force restoring elements 7 hold the short and elongated brace members 8 and 9 in bearing relation in a first selected relative position 100 where the brace has a minimum effective length 101 measured from the first attachment point 3 to the second attachment point 5.

Figure 9:
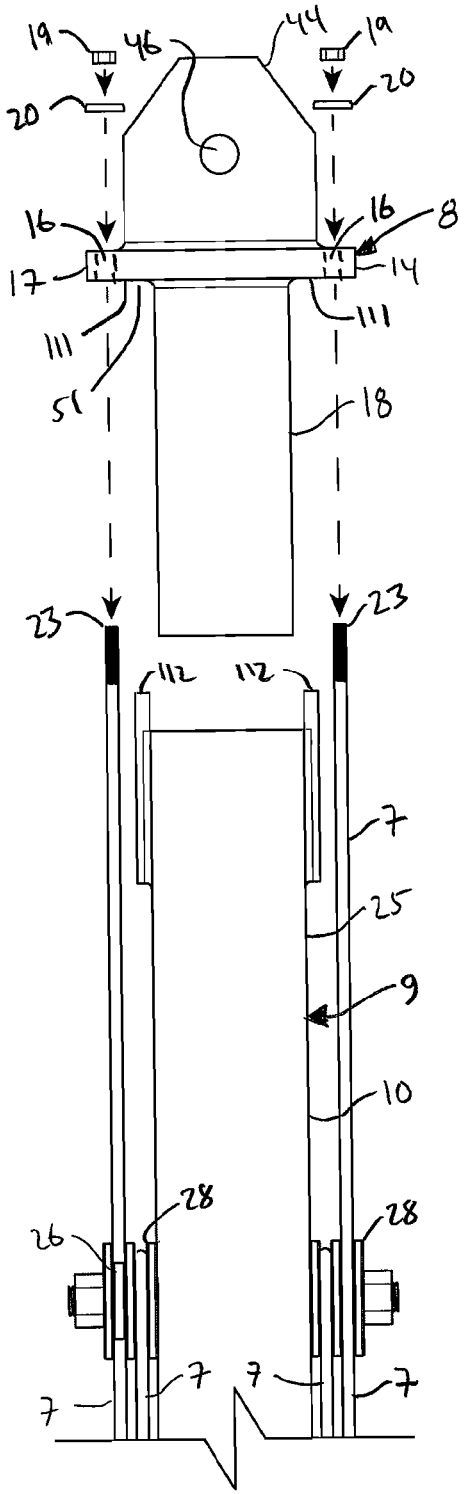
FIG. 9 is an exploded top view of the centering brace of FIG. 1, showing how the short brace member is received by the elongated brace member.
Figure 10:
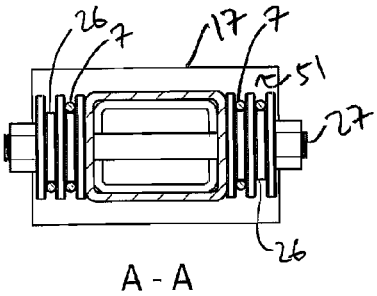
FIG. 10 is a cross-sectional side view of the centering brace of FIG. 1 taken along line A-A of FIG. 2.
Figure 11:
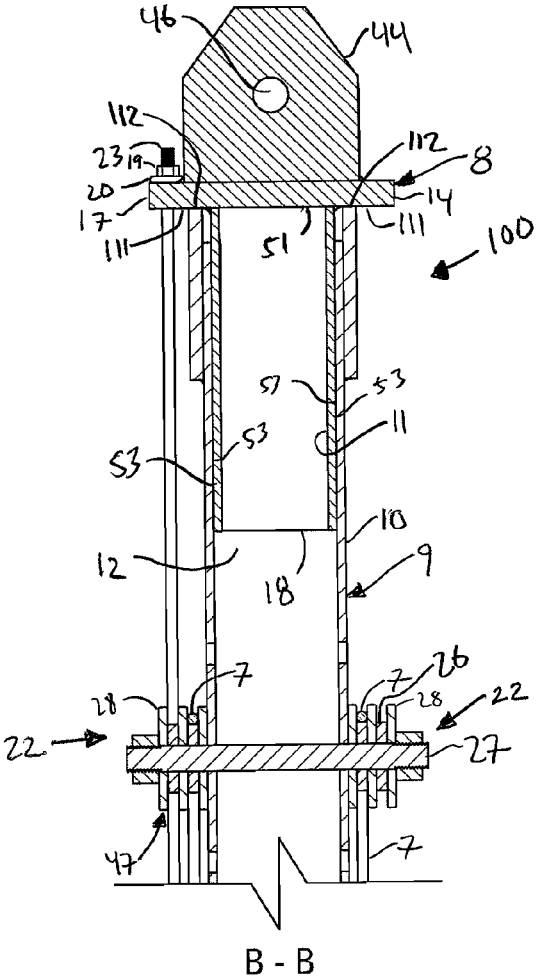
FIG. 11 is a cross-sectional front view of the centering brace of FIG. 1 taken along line B-B of FIG. 3.

In the preferred embodiment, as shown in FIGS. 9 and 11, the short brace member 8 is substantially shorter than the elongated brace member 9. The short bearing member 8 is received within the main body 10 of the elongated bearing member in nesting engagement. Preferably, the short brace member has a male fitting 11 which is inserted into a female opening 12 in the elongated brace member. As shown in FIG. 11, the brace members 8 and 9 are each formed with pairs of alignment faces 53 that engage with at least one matching pair of alignment faces 53 on a different brace member to align the brace members along the main axis 15 of the brace. Preferably, the brace members 8 and 9 are made from steel, hollow structural sections with rectangular (including square) cross-sections, but may include other cross sections such as round houllon, I-shaped open or other built-up cross sections. In order for the elastic restoring force elements 7 to provide a centering force between the first and second attachment points 3 and 5, the elastic restoring force elements 7 must be in tension, and since the elastic restoring force elements connect the short brace member 8 to the elongated brace member 9, the short brace member 8 and the elongated brace member 9 will meet and bear upon each other in the absence of any separation forces between the members. Thus, the short brace member is formed with a first bearing surface 111 and the elongated structural member is formed with a second brace surface 112.

Figure 14:
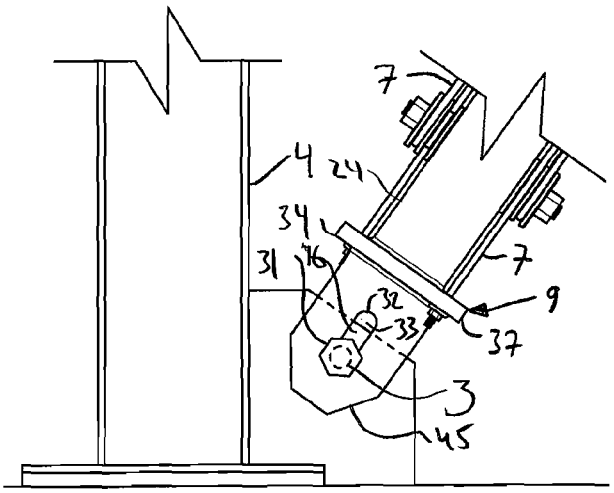
FIG. 14 is an enlarged front view of one of the centering braces of the present invention installed in a building frame, showing the attachment of the centering brace to the upright of the frame.
Figure 15:
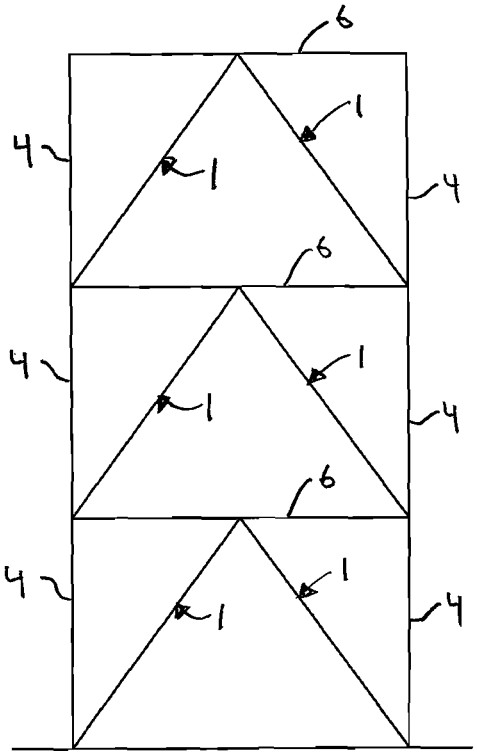
FIG. 15 is a schematic view of a three-story building frame with diagonal bracing.
Figure 16:
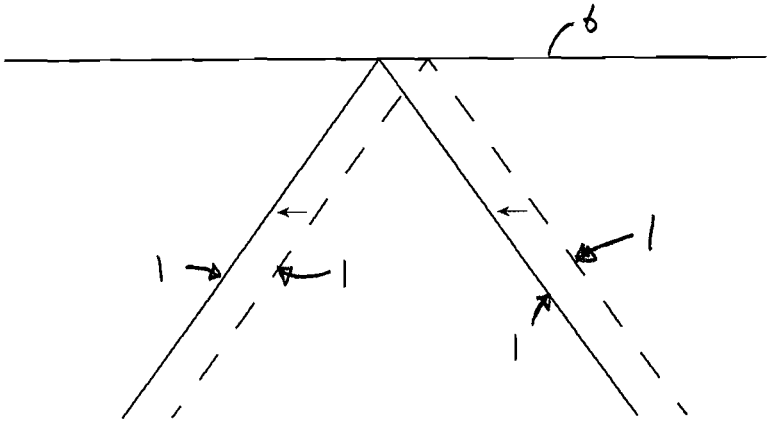
FIG. 16 is a schematic view of the connection between a pair of diagonal braces and a beam in a building frame with the dotted lines representing the positions of the braces when the building is subjected to a lateral load that causes deformation, and the arrows representing the movement that must take place to return the braces to their original positions.

As noted above, preferably, the brace 1 has a relatively short brace member 8 and an elongated brace member 9. As shown in FIGS. 12 and 14, the shorter brace member 8 is located above the elongated brace member 9, but the elongated brace member 9 could be reversed and the shorter brace member 8 could be disposed at the lower end of the elongated brace 9 with the elongated brace member 9 disposed above the short brace member 8.

Figure 8:
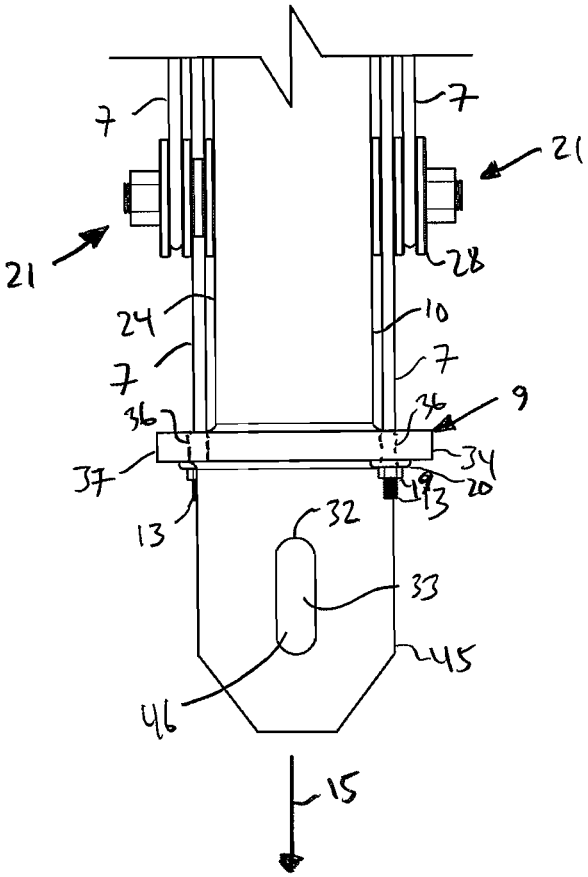
FIG. 8 is an enlarged top view of the centering brace of FIG. 1 at the end of the elongated brace member.

Preferably, the elastic force restoring elements 7 are elongated steel cables 7. As shown in FIG. 1, a first end 13 of each cable 7 that is used (two cables 7 are shown being used in FIG. 1) is attached to the short brace member 8. The short brace member 8 is provided with one or more connection flanges 14 that are disposed laterally of the main axis 15 of the brace 1. Each connection flange 14 is provided with an opening 16 for receiving the cable 7. In the preferred embodiment, the connection flanges 14 make up a connection plate 17 that is attached to the tubular main body 18 of the short brace member 8. As shown in FIGS. 8 and 9, in the preferred embodiment, at the end of the cable 7 a threaded portion is provided and a fastener 19 is attached, preferably threaded, on to the cable 7 with a washer 20 disposed between the fastener 19 and the connection flange 14. The threaded connection between the fastener 19 and the cable allows for the tensioning of the cable 7. Gripping elements as are commonly found in concrete tensioning system that use the tension on the cable to compress the gripping elements into a tapering sleeve that receives the gripping elements could also be used to fasten the cable to the short brace member.

As is shown in FIG. 1, in the preferred embodiment, the cable 7 is inserted through the opening 16 in the connection flange 14 and drawn away from the short brace member 8 to a return member or first redirecting pulley 21 on the elongated brace member 9 such that the cable 7 is redirected back toward the short brace member 8. In the preferred embodiment shown in FIG. 1, a second pulley 22 is attached to the elongated brace member 9 at a distance along the elongated brace member 9 that is removed from the first redirecting pulley 21. The cable 7 is wound over this second pulley 22 as well, before the second end of the 23 cable is anchored to the end 24 of the elongated brace member 9 that is distally located from the short brace member 8. Preferably, the second pulley 22 is located near the end 25 of the elongated brace member 9 that is proximal to the short brace member 8 and the first redirecting pulley 21 is located near the end 24 of the elongated brace member 9 that is distal from the short brace member 8. Thus, in the preferred embodiment each elastic restoring force element 7 first extends along the main axis 15 of the brace 1 away from the first end of the brace 1, and then extend along the axis of the brace 1 toward the first end 13 of the elastic restoring force element 7, and then to extend again away from the first end 13 of the elastic restoring force element 7. Additional pulley 21 and 22 could be provided such that the elastic restoring force elements 7 repeat this process a number of times.

Preferably, the pulleys 21 and 22 are wheels 26 on axles 27 fixed to the distal and proximal ends 24 and 25 of the elongated brace member 9 of the brace 1. The wheels are preferably formed with extended rims 28 that align the cables 7 in place over the wheels 26. The brace may also be provided with guides 47 for the elastic restoring force elements 7 to prevent them from potentially interfering with their own movement when the distance between the first and second attachment points 3 and 5 is increased and the elastic restoring force elements are stretched. In the preferred embodiment, the guides 47 are formed as part of the pulleys 21 and 22 and in fact are additional wheels 26 on axles 27, it is just that the elastic restoring force elements 7 run straight through the guides 47 rather than being run over half the circumference of the wheel 26 such that the cables 7 reverse direction.

For load balance on the brace, this cable and pulley system would be used in pairs, one on the top and bottom of the brace 1, and as shown, the axles 27 run through the brace 1 connecting the first pulley 21 to a corresponding first opposite pulley 29 and connecting the second pulley 22 to a second opposite pulley 30. The first and second opposite pulleys 29 and 30 are located on the opposed bottom of the brace from the first and second pulleys 21 and 22 on the top.

To protect the tension only brace 1, it is preferable to prevent the brace 1 from acting in compression. One preferred attachment method for preventing the brace 1 from acting in compression is to make the connecting mechanism to either the beam 6 or column 4 as a slot or slots 33 parallel to the main axis 15 of the brace 1. The installed condition of the brace 1 would place the connecting bolt or bolts 31 tight against the end 32 of the slot 30 disposed farther from the opposite attachment point to start with so that the brace 1 can instantly take tension, but if the brace 1 were to try to act in compression, the slot 33 would allow the brace to slide past the bolt 31. In the drawings only one bolt 31 is shown to make the connection of the brace 1 to the attachment point, but multiple bolts 31 in multiple openings or slots 33 could be used. Also, as opposed to forming the slot or slots 33 in the brace 1, the slot or slots 33 could be formed in the attachment point 4 or 5 on the frame 2, and the bolt 31 pushed by the brace 1 would slide in the slot 33.

As shown in FIG. 1, the distal end 24 of the elongated brace member 9 is provided with one or more connection flanges 34 that are disposed laterally of the main axis 15 of the brace 1. Each connection flange 34 is provided with an opening 36 for receiving the restoring force element or cable 7. In the preferred embodiment, the connection flanges 34 make up a connection plate 37 that is attached to the tubular main body 10 of the elongated brace member 9. As shown in FIG. 8, in the preferred embodiment, at the end of the cable 7 a threaded portion is provided and a fastener 19 is attached, preferably threaded, on to the cable 7 with a washer 20 disposed between the fastener 19 and the connection flange 34.

As best shown in FIGS. 1, 6, 7, 9 and 11, the second bearing surface 112 of the elongated structural member 9 is made up of the ends 41 of two separate spacing members 42 disposed on and attached to opposed faces of the elongated brace member 9. As shown in the drawings, the spacing members 42 are attached to the elongated brace member 9 by welding. The ends 41 of the spacing members 42 bear against the first bearing surface 111 of the short brace member 8, which as shown in the drawings consists of the proximal face 51 of the connection plate 17 of the short brace member 8. This protects the welded connection between the connection plate 17 and the main body 18 of the short brace member 8.

As shown in FIG. 1, in the preferred embodiment, the pair of cables 7 are disposed in opposite relation around the brace 1 with their attachment to the connection plates 17 and 37 being on diagonals.

Also in the preferred embodiment, multiple openings 43 are provided in the brace 1 for the axles 27 to allow variation in the positioning of the pulleys 21 and 22.

In the preferred embodiment attachment flanges 44 and 45 are attached to the connection plates 17 and 37. The flanges 44 and 45 have openings 46 or slots 33 for connection to the attachment points 3 and 5 by means of the connecting bolt 31.

Figure 13:
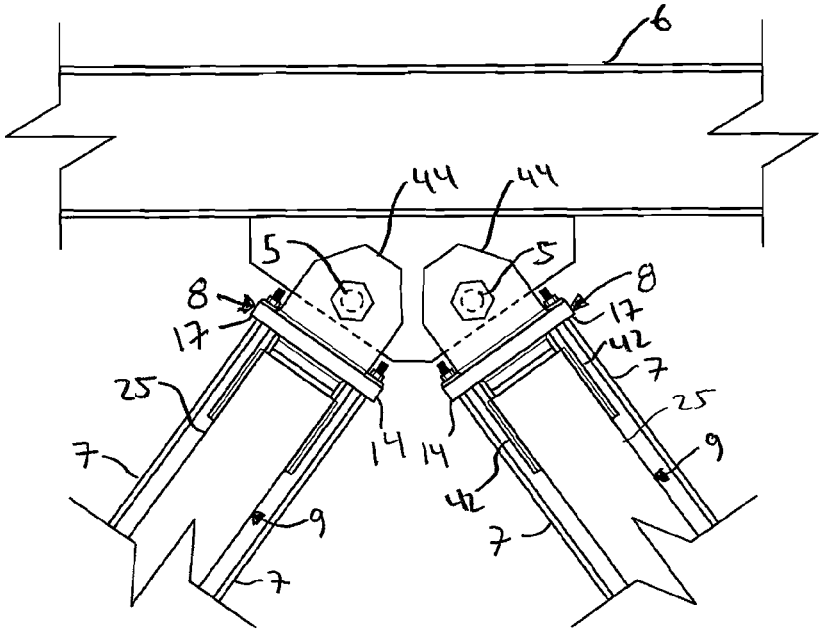
FIG. 13 is an enlarged front view of the pair of centering braces of the present invention installed in a building frame, showing their attachment to the beam.

As shown in FIGS. 12 and 13 two centering braces 1 are used to connect two posts 4 to a beam 6, and the frame has yield links 52 between the beams 6 and the posts 4.

I claim:

1. A connection between a first structural member and a second structural member in a structural frame, the connection comprising:

a. the first structural member, having a first attachment point;

b. the second structural member, having a second attachment point spaced away from the first attachment point, the second structural member being in operative connection with the first structural member;

c. a brace spanning the distance between the first and second attachment points and connecting to the first and second structural members at the first and second attachment points, the brace having a minimum effective length that is the distance between the first and second attachment points when the first and second structural members are not subject to external lateral loading, the brace also being able to expand in length from the first effective minimum effective length when the structural frame is subjected to lateral loading that increases the distance between the first and second attachment points, the brace including:

i. a plurality of brace members in sliding engagement with each other, one of the plurality of brace members being connected to the first attachment point and one of the plurality of brace members being connected to the second attachment point, the first and second attachment points defining an elongated axis of the brace;

ii. one or more elastic restoring force elements that generally extend along the elongated axis of the brace, each elastic restoring force element being in connection with at least the brace members connected to the first and second attachment points, the one or more elastic restoring force elements being flexible such that the one or more elastic restoring force elements are run over one or more return members connected to the brace such that each elastic restoring force element extends along the axis of the brace member away from the first attachment point and is redirected over one of the return members and then extends along the axis of the brace member towards the first attachment point, and such that the one or more elastic restoring force elements have a minimum effective length that is greater than the minimum effective length of the brace.

2. The connection of claim 1, wherein:

the brace members of the plurality of brace members are each formed with pairs of alignment faces that engage with at least one matching pair of alignment faces on a different brace member to align the brace members along the main axis of the brace.

3. The connection of claim 1, wherein:

the one or more return members consist of wheels mounted on axles mounted to the brace.

4. The connection of claim 1, wherein:

the one or more elastic restoring force elements are elongated members having first and second ends, and the first end of each elastic restoring force element is attached to the brace member connected to the first attachment point and the second end of each elastic restoring force element is attached to the brace member connected to the second attachment point.

5. The connection of claim 4, wherein:

the brace member attached to the first attachment point is formed with a first lateral connection flange that receives the first ends of the one or more elastic restoring force elements and the brace member attached to the second attachment point is formed with a second lateral connection flange that receives the second ends of the one or more elastic restoring force elements.

6. The connection of claim 4, wherein:

the brace is provided with two return members and each elastic restoring force element is run around each return member at least one time in a manner that causes each elastic restoring force element to first extend along the axis of the brace member away from the first end of the brace member, and then extend along the axis of the brace member toward the first end of the elastic restoring force element, and then to extend again away from the first end of the elastic restoring force element.

7. The connection of claim 1, wherein:

the brace is also provided with guides for the elastic restoring force elements to prevent them from interfering with their own movement when the distance between the first and second attachment points is increased and the elastic restoring force elements are stretched.

8. The connection of claim 7, wherein:

the one or more guides consist of wheels mounted on axles mounted on the brace.

9. The connection of claim 1, wherein:

the connection between the first and second structural members includes a yield link connecting the first and second structural members.

10. The connection of claim 1, wherein:

the brace is connected to either the first or second attachment point with a sliding connection.

11. The connection of claim 1, wherein:

the plurality of brace members comprises a short brace member and an elongated brace member with the short brace member having a first bearing surface and the elongated brace member having a second brace surface with the first bearing surface and the second brace surface being in contact when the first and second structural members are not subject to external lateral loading and the brace is disposed at its minimum effective length.

12. The connection of claim 11, wherein:

a. the elongated brace member is attached to the first attachment point and the short brace member is attached to the second attachment point, b. the one or more elastic restoring force elements are elongated members having first and second ends, and the first end of each elastic restoring force element is attached to the elongated brace member and the second end of each elastic restoring force element is attached to the short brace member.

13. The connection of claim 12, wherein:

a. the brace is provided with a plurality of return members, and the return members are attached to the elongated brace, and b. each elastic restoring force element is run around each return element at least one time in a manner that causes each elastic restoring force element to first extend along the axis of the brace member away from the first end of the brace member, and then extend along the axis of the brace member toward the first end of the elastic restoring force element, and then to extend again away from the first end of the elastic restoring force element.

14. The connection of claim 13, wherein:

the brace is also provided with guides for the elastic restoring force elements to prevent them from interfering with their own movement when the distance between the first and second attachment points is increased.

15. The connection of claim 14, wherein:

the elongated brace member is formed with a first lateral connection flange that receives the first ends of the one or more elastic restoring force elements and the short brace member is formed with a second lateral connection flange that receives the second ends of the one or more elastic restoring force elements.

16. The connection of claim 15, wherein:

the brace is provided with pairs of elastic restoring force elements with the elastic restoring force elements of each pair being mounted in opposed relation with respect to the brace.

17. The connection of claim 16, wherein:

the brace is also provided with guides for the elastic restoring force elements to prevent them from interfering with their own movement when the distance between the first and second attachment points is increased and the elastic restoring force elements are stretched.

18. The connection of claim 17, wherein:

the one or more guides consist of wheels mounted on axles mounted on the brace.

19. The connection of claim 18, wherein:

the brace is connected to the first or second attachment point with a sliding connection.

20. The connection of claim 19, wherein:

the connection between the first and second structural members includes a yield link connecting the first and second structural members at a location away from the brace.

* * * * *